United States Patent [19]

Alberny et al.

[11] 3,981,345

[45] Sept. 21, 1976

[54] METHOD TO IMPROVE THE STRUCTURE OF CAST METAL DURING CONTINUOUS CASTING THEREOF

[75] Inventors: Robert Alberny, Metz; Alain Leclercq, Alpa Porcheville; Jean-Pierre Birat, Metz, all of France

[73] Assignee: Institut de Recherces de la Siderurgie Francaise (IRSID), Saint-Germain-en-Laye, France

[22] Filed: May 21, 1974

[21] Appl. No.: 471,972

[30] Foreign Application Priority Data

May 21, 1973 France ..... 73.18329

[52] U.S. Cl. ..... 164/49; 164/82

[51] Int. Cl.[2] ..... B22D 27/02; B22D 11/10

[58] Field of Search ..... 164/49, 82, 250, 147

[56] References Cited

UNITED STATES PATENTS

| | | | |
|---|---|---|---|
| 2,877,525 | 3/1959 | Schaaber | 164/82 X |
| 2,963,758 | 12/1960 | Pestel et al. | 164/49 X |
| 3,693,697 | 9/1972 | Tzavaras | 164/82 X |

FOREIGN PATENTS OR APPLICATIONS

| | | | |
|---|---|---|---|
| 449,140 | 6/1948 | Canada | 164/49 |
| 449,859 | 4/1968 | Switzerland | 164/82 |

*Primary Examiner*—Ronald J. Shore

*Attorney, Agent, or Firm*—Michael J. Striker

[57] ABSTRACT

A method of continuously casting metal in which the metal is subjected during its solidification at a predetermined zone to the action of a magnetic field which is controlled as a function of the withdrawal speed of the metal during the continuous casting thereof to maintain in the region of the solidification of the metal a magnetic pressure between two predetermined limits to thereby agitate the metal during its solidification to improve the structure of the cast product especially in a central axial zone of the product.

4 Claims, 5 Drawing Figures

METHOD TO IMPROVE THE STRUCTURE OF CAST METAL DURING CONTINUOUS CASTING THEREOF

BACKGROUND OF THE INVENTION

The present invention relates to a method to control and improve the structure of continuously cast metallic products during their solidification.

It is already known to subject metals during their solidification, and while being continuously cast, to the action of a magnetic field in order to cause movement of the liquid metal in the interior of the continuously cast product. The magnetic field, which is usually created by an inductor arranged in close proximity to the outer surface of the continuously cast product, will create in the product currents and consequently mechanical forces which will produce in the liquid non-solidified portion of the continuously cast product a movement of the liquid metal.

It is also known that by such movement of the liquid metal a modification of the structure of solidification of the cast product will be obtained. In fact, such structure will depend on various parameters such as the temperature gradient in the zone of the beginning solidification, the speed of growth of the solid portion of the cast product, the concentration of the solute in the liquid, and these parameters are modified by imparting a movement to the liquid metal in the center of the cast product. These various factors are interdependent and it is only possible by experimentation to determine the overall qualitative influence on the structure of the solidified product, obtained by imparting a movement to the liquid metal during its solidification.

The general aim of imparting by an electromagnetic field, a movement of the liquid metal during its solidification, is to avoid the formation of a basaltic structure in the center of the cast product. The term basaltic structure is to be understood as a structure resulting from a solidification in the form of branched dendrites oriented according to the temperature gradient, that is generally perpendicular to the outer surface of the cast product. This type of solidification is particularly encountered during the casting of steel and it occurs usually in a portion of the product in a zone intermediate the outer surface and the core of the product and this zone is liable to extend at least locally up to the center of the product. It has been ascertained that this type of solidification may impart to the product unfavorable mechanical characteristics even after treatment of the same by subsequent forging or hammering.

The favorable effect of an electromagnetic movement or mixing of the liquid metal to suppress such basaltic growth and to replace it by a solidified structure with an improved quality is well known. Particularly, it has already been proposed to utilize this technique to act on the structure of solidification of products which are continuously cast. In fact, the transformation of such products into products of improved quality will be obtained rather by a relatively slow rate of casting than in the case of big ingots obtained by casting the same in the usual manner, which does not permit to mitigate with sufficient efficiency formation of a structure of solidification of the basaltic type.

However, experimental observations have so far not permitted to apply the electromagnetic mixing technique in such a manner so as to obtain a predetermined desired result, regardless of the type of product cast and the conditions during such casting. In the technical exploitation of this technique it is, however, important to impart to the cast product predetermined characteristics which are relatively constant.

SUMMARY OF THE INVENTION

It is an object of the present invention to determine the operating conditions of imparting a movement to the liquid metal by applying an electromagnetic field thereto during the continuous casting of the metal in order to obtain in a constant and reproducible manner a specific predetermined structure of solidification of the cast product.

It is also an object of the present invention to provide a method to control the structure of solidification of a metallic product which is continuously cast and in which the product during its solidification is passed through a magnetic field which provokes a movement of the liquid metal at least in a zone in front of its solidification, i.e., at the border between the already solidified material and the still liquid metal.

According to the method of the present invention, a magnetic field is applied to the continuously cast metal in a region in which the relationship between the total thickness of the solidified metal and the overall width of the product in the same cross section is substantially $1 : \sqrt{2}$, in which the action of the magnetic field is maintained over a distance $l$ determined by the equation $$l = KV_M,$$

in which $V_M$ is the maximum value of the withdrawal speed of the product in meters per minute and $K$ is a constant which is approximately 0.17, the withdrawal speed of the product cast is continuously measured, and the intensity of the applied magnetic field is regulated as a function of the withdrawal speed of the cast product in order to maintain constant a value $a$ defined by the equation $$a = B_0 \cdot e(V) \cdot \sqrt{\frac{f}{\rho}},$$

in which $B_0$ is the effective value in Tesla of the induction in air in the region where the front of the solidification is formed, that is at the border between the solidified and the liquid metal, $f$ is the frequency in Hertz of the current supplied to a bipolar inductor which produces a turning magnetic field applied on a reference product of a circular section having the same diameter as the thickness of the cast product and solidifying in the same manner as the product, $\rho$ is the resistivity of the liquid metal cast in ohm-meter and $e(V)$ is the median distance between two opposite points at the front of the solidification in a direction perpendicular to the external surface of the cast product in the zone of the action of the magnetic field, this distance being determined by the equation $$e(V) = E - 2k \sqrt{\frac{H}{V}}$$

in which:

$E$ is the distance in meters between two points of the surface of the product in a direction perpendicular to this surface, $k$ is a coefficient of solidification specific to the product, $V$ is the instantaneous withdrawal speed of the cast product expressed in meter per minute, and $H$ is the distance in meter between the median level at which the magnetic field is applied and the level at which the cross section of the cast product is completely liquid.

According to an advantageous form of the present invention, the value of the constant $a$ is maintained within the limits of $$3.5 \text{ to } 5.3 \ \frac{\text{Tesla} \cdot m}{s^{0.5} \cdot \Omega m^{0.5}}$$

The method according to the present invention permits to determine the conditions of applying an electromagnetic field to a continuously cast product during the casting thereof in order to obtain the desired result in the structure of solidification of the cast product to which the magnetic field is applied. These conditions permit the user to determine the operating conditions during the continuous casting, that is:

a. the location at which the magnetic field has to be applied during the process of solidification of the cast product;

b. the intensity of the magnetic field to be applied; and c. the minimum duration of application of the magnetic field.

In the absence of the above-mentioned specific features the operator would not be in a position to obtain a strictly qualitative action of applying a movement to the liquid metal in the interior of the cast product and in this case such action may occur without notable effect or even produce detrimental effects as far as the structure of solidification of the product is concerned.

The method according to the present invention permits to determine the initial criteria of the treatment of the cast metal by the application of an electromagnetic field as a function of the dimension of the cast product and as a function of the cooling of this product. In addition the method permits to reproduce in a casting process the desired results in order to obtain a product with a structure of solidification the characteristics of which are substantially constant.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
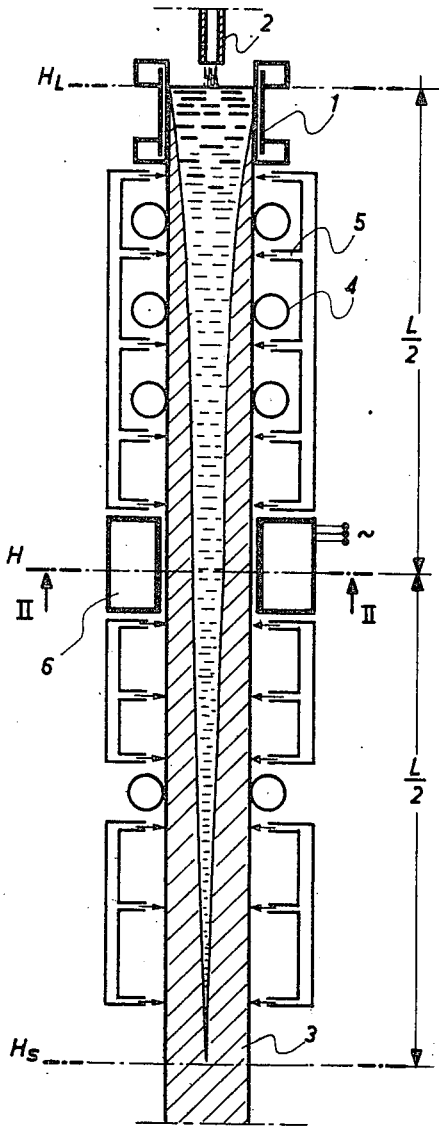
FIG. 1 is a schematic, longitudinal cross section through an apparatus for continuously casting metal in vertical direction in which the apparatus is provided with means for applying an electromagnetic field to the product during the casting thereof.

FIG. 1 schematically illustrates an apparatus for the continuously casting of metal in which, for instance, billets of square cross section are produced. The apparatus comprises a water cooled mold 1 which is supplied in a continuous manner with liquid metal from a nozzle 2. The billet 3 during its solidification may be engaged downstream of the mold 1 by driven rollers 4 so that the billet is continuously moved in vertically downward direction. The billet is cooled downstream of the mold by a plurality of water jets emanating from nozzles 5 and impinging on the outer surface of the billet. The cross section of the billet is completely solidified at the level $H_s$ which is distant from the level $H_L$ of the liquid level in the mold 1 by a distance L generally called "metallurgical length." Over this length the liquid metal forms in the billet a central well in the form of an elongated cone. It is to be understood that the liquid well is illustrated in FIG. 1 only by way of an example and it should not be presumed that the showing of FIG. 1 actually illustrates the relationship existing between the metallurgical length and the dimensions of the cast billet. According to the method of the present invention, an electromagnetic inductor 6 of known type is arranged adjacent to the outer surface of the cast product in a zone of this product in which the relationship between the total thickness of the solidified metal and the width of the metal is substantially $1 : \sqrt{2}$.

The electromagnetic inductor is constituted by a metallic frame provided with coils supplied with electric current and the coils are connected in a manner to constitute three bipolar windings respectively connected to one phase of a three-phase alternating supply current. This type of inductor will create a rotating electromagnetic field, the intensity of which will be substantially constant over the whole section of the cast product, which will create a corresponding movement of the liquid metal in the interior of the product. The magnetic field created by the inductor will induce in the interior of the product currents which, in turn, will result in mechanical forces which will impart to the liquid metal a rotary movement, which increases with increase of the intensity of the field produced by the inductor.

Figure 2:
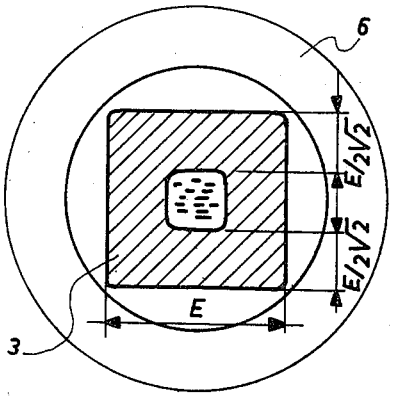
FIG. 2 is a transverse cross section taken along the line II—II of FIG. 1.

FIG. 2 represents a transverse cross section through the billet taken in a median plane through the electromagnetic inductor 6 and the width of the billet is designated with E, whereas the total thickness of the solidified metal in this zone is chosen in the neighborhood of $E/\sqrt{2}$.

So far, a first step according to the present invention has been described which comprises the step of selecting along the metallurgical length of the cast product the zone at which the electromagnetic field is to be applied and which is determined as a function of the thickness of the solidified metal. The choice of this zone is a result of metallurgical considerations which are outlined in the following.

Starting from the observation that the formation of structure of solidification of the basaltic type does not by itself constitute trouble, the aim is not only to prevent more or less complete formation of such structures, but to determine a preferred zone to apply the electromagnetic field in order to eliminate in a systematic manner other phenomena which are connected with the growth of a basaltic structure and which occur especially in the axial zone of the cast product.

Figure 3:
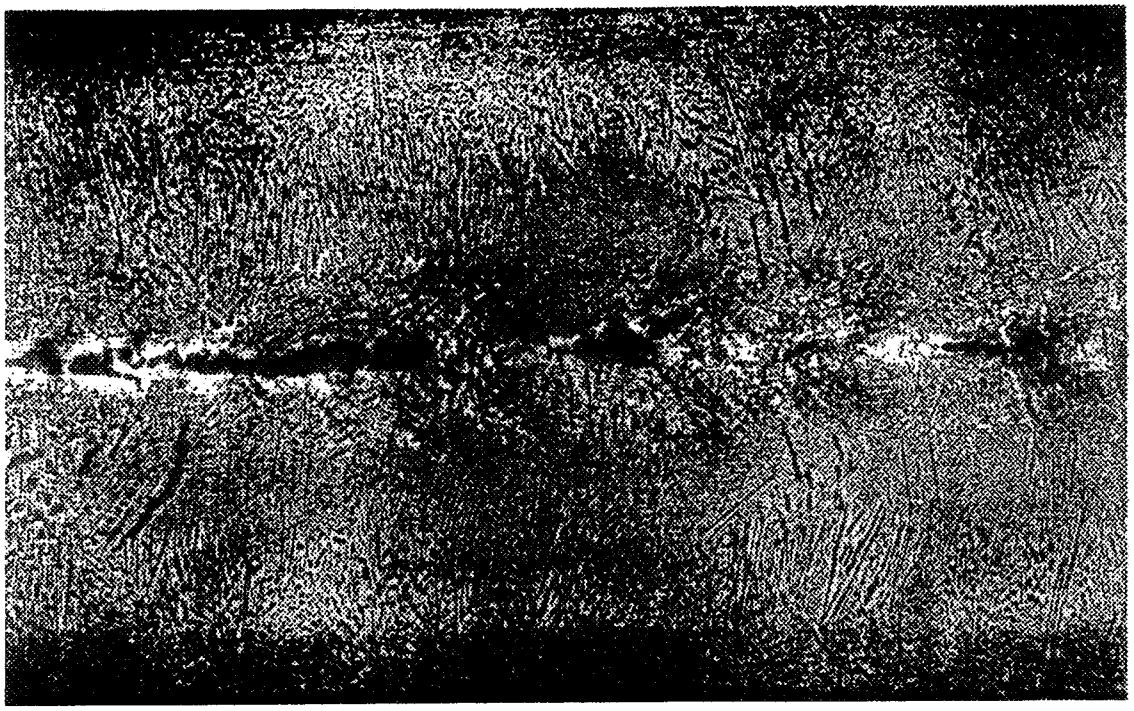
FIG. 3 is a partial longitudinal cross section through a casting which has not been subjected to the method according to the present invention.

Referring to the longitudinal cross section through a billet continuously cast without application of an electromagnetic field, and illustrated in FIG. 3, the existence of a discontinuity of the structure in the axial zone of the cast product will be observed which does not reflect at all the apparent continuity of the process of solidification. This discontinuity is explained by the formation of so-called "bridges of solidification" which phenomenon is connected with the basaltic growth. A bridge of solidification is understood as a local phenomenon occurring when the cast product is solidified complete across a section which is situated at a distance from the liquid level in the mold which is substantially inferior to the metallurgical length of the product and such an occurrence has the effect to separate the well of liquid metal in parts respectively located above and below such a bridge of solidification. The repeated formation of such bridges of solidification will result into pockets of liquid metal which are practically independent from each other and in which will develop at a reduced scale phenomena similar to the phenomena encountered during the casting of ingots according to the prior art, that is the formation of shrink holes at the upper end of the ingot, segregation of inclusions which will gather in the form of a mass at the lower end of the ingot, and heterogeneity of the composition along the length of the ingot. These phenomena are practically irreversible and constitute a major drawback of the continuous casting method since it is impossible to detect during the casting whether a shrink hole is present or not.

The formation of such bridges of solidification may be explained by an irregular local growth of the basaltic structure in which the dendrites join each other in the axial region of the cast product, or in which the dendrites become detached from the outer solidified portion of the casting and amass at a local obstruction, or by a combination of both phenomena.

According to the present invention it is especially thought to avoid the premature formation of such bridges of solidification in order to avoid formation of successive "sub-ingots" and the heterogeneity of the cast product which is associated with such a mode of solidification.

These considerations have led applicants to consider whether there exists a degree of solidification of the product at which an irregular, substantially irreversible formation at the well of the solidification will occur which will result in successive sub-ingots. It has been ascertained that this condition is encountered relatively late in the course of the process of solidification. Systematically carried out experimental observations have shown that the bridges of solidification are liable to form in a zone of the liquid well which is located below a section of the cast product in which the relationship of the total thickness of the solidified material to the width of the cast product is substantially $1 : \sqrt{2}$.

An application of a magnetic field downstream of the section defined above will remain without effect as far as the formation of sub-ingots is concerned and will lead only to a modification of the structure of solidification in each of these sub-ingots without, however, preventing the formation of shrink holes. It is therefore necessary to apply the magnetic field which produces movement of the liquid metal portion upstream or at the level of the aforementioned section. According to the present invention, the magnetic field is applied at the level of the aforementioned section, that is as late as possible during the process of solidification, in view of the above-described phenomenon of the basaltic growth. It has been established that a premature mixing treatment of the cast metal will locally arrest basaltic growth, but will nevertheless remain inoperative as far as the formation of sub-ingots is concerned, the growth of basaltic formation is liable to occur after the treating zone if the zone is distant from the specific section as defined above.

The specific choice of the zone of applying the magnetic field is therefore an essential step of the method according to the present invention in that it permits to act on a basaltic zone before sub-ingots are formed, while avoiding substantially the phenomenon of regrowth of basaltic formations downstream of the mixing zone.

The preferred zone at which the magnetic field is to be applied is located along the "metallurgical length" at a level in which the relationship between the thickness of the solidified skin and half of the width of the product is substantially $1 : \sqrt{2}$. It is advantageous to establish this condition by specifying the preferred placement of the inductor in relation to the cast product.

As known, the general law of solidification of a continuously cast product may be expressed in a simplified form by the equation:

$$E_S = kt^{0.5} \qquad (1)$$

in which:

$E_S$ is the thickness of the solidified skin, $t$ is the time passed from the initial instant of solidification, and $k$ is a constant of solidification which depends on the operating conditions and on the nature of the cast metal.

The development of the thickness of the solidified skin occurs along a parabolic curve. If the level of the liquid metal in the mold is designated $H_L = 0$, and if the level at which the cross section of the product is completely solidified is designated with $H_S$, the metallurgical length is expressed by the formula $L = H_S - H_L$.

If the preferred level at which the magnetic field is to be applied is designated with H, and if the width of the product is designated with E, the thickness of the solidified skin at the aforementioned preferred level H has to be $$E_S = E/2\sqrt{2}.$$

If the speed at which the cast product is withdrawn is designated V, one obtains, considering the relationship of the formula (1):

$$E_S = k\sqrt{\frac{H}{V}} = \frac{E}{2\sqrt{2}}$$

and $$k\sqrt{\frac{H_S}{V}} = \frac{E}{2}$$

and by division $$\sqrt{\frac{H}{H_S}} = \frac{1}{\sqrt{2}}$$

and thus $$\frac{H}{H_S} = \frac{1}{2}$$

Therefore, the preferred zone at which the magnetic field is applied according to the method of the present invention is located substantially midway of the liquid well in the cast product, or in other words, the preferred location at which the electromagnetic field is applied is located substantially at a level corresponding half to the metallurgical length.

However, the disposition above explained will produce the desired result only in combination with complementary features which are discussed below. In fact, an insufficient mixing treatment, even though applied in the preferred zone, the position of which has been set forth above, will not prevent the formation of bridges of solidification. On the other hand, an excessive mixing treatment may produce certain detrimental metallurgical effects which will be set forth in detail further below.

First of all, the movement of the liquid metal in the interior of the ingot under the action of the magnetic field will develop in a progressive way due to the existence of inertia forces and the natural movement of the liquid metal due to convection. It is therefore necessary to maintain the action of the magnetic field through a certain minimum distance $l$ such that the prevailing relative movement which is established in the interior of the ingot is the movement created by the magnetic field applied. This minimum distance can be the smaller, the greater is the intensity of the magnetic field applied by a predetermined electromagnetic inductor at a predetermined frequency, and this minimum distance has to be the greater, the greater is the withdrawal speed of the cast product. In other words, the desired result of the mixing process is obtained by a magnetic field of predetermined characteristics when the duration of the mixing process reaches or surpasses a certain minimum value. It has been established by the inventors that this minimum value is in the neighborhood of 10 seconds for a mixing action produced by a turning magnetic field applied to molten metal. From this results that if $V_M$ is the maximum withdrawal speed in meters per minute for the cast metal and a given apparatus, the minimum distance, also measured in metals, over which the magnetic field has to be applied is given by the equation:

$$l = KV_M$$

in which $K \geqq 0.17$.

In the following the value of the intensity of the magnetic field to be applied in order to obtain the desired results and to prevent basaltic growth in the zone in front of the solidification will be more precisely specified in combination with the considerations set forth above.

Reference is made by way of an example to a particular case of mixing treatment applied to a circular section of a billet which is encompassed by an electromagnetic inductor as represented in FIG. 1. As mentioned above, such an inductor adapted for the specific type of application is a bipolar inductor so as to create a magnetic field which is substantially constant from the periphery to the center of the billet. Furthermore, a three-phase alternating current is used in this case as supply current for the inductor which has three pairs of poles and in which each pair of poles is supplied with one phase of the supply current. The speed of rotation of the turning magnetic field created by this type of inductor is expressed by the formula:

$$\omega = \frac{2\pi f}{p}$$

in which $f$ is the frequency of the supply current and $p$ is the number of pairs of poles per phase, which number is 1 in the inductor under consideration.

Under these conditions it is possible to calculate the value of the curvilinear integral of the magnetic force $p$ developed along the border between the solidified and the liquid metal according to the law of Laplace by the interaction of the magnetic field and the Foucault current induced in the cast product by the formula:

$$p = \frac{\pi\omega}{4\rho} B^2 e^2 \qquad (2)$$

in which:

$\omega$ is the rotation of the field, $\rho$ is the resistivity of the liquid metal, $B$ is the maximum value of the induction, and $e$ is the diameter of the liquid metal at the level of action of the magnetic field.

The value $p$ set forth above is designated as "magnetic pressure" in the description which follows.

The inventors have established by experimentation that the value of the magnetic pressure constitutes the decisive factor is arresting basaltic growth in that such magnetic pressure will cause rupture of the extremities of the dendrites penetrating into the liquid well. It has been established that there exists a necessary minimum value of magnetic pressure and that below this minimum value the treatment of mixing by applying a magnetic field will remain inoperative. It has been further experimentally established by the inventors that the minimum effective value of the magnetic pressure is in the neighborhood of 120 Pascal or $1.22 \times 10^{-3}$ kilogram per centimeter square, or 0.0174 lbs. per square inch. The effective value of the magnetic pressure is understood as a value calculated from the effective value of induction $B_o = B/\sqrt{2}$.

The formula (2) shows that the magnetic pressure decreases from the periphery toward the center of the billet in accordance with the square of the distance. For a specific cast material, the equation (2) may be expressed in the form:

$$B = a \sqrt{\frac{\rho}{\omega}} \cdot \frac{1}{e}$$

in which $$a = \sqrt{\frac{4p}{\pi}}$$

is a constant.

For an effective value of the magnetic pressure equal to $1.22 \times 10^{-3}$kg/cm$^2$ , the following relationship is obtained:

$$B_o = 3.5 \sqrt{\frac{\rho}{f}} \cdot \frac{1}{e}$$

in which $B_o = B/\sqrt{2}$ is the effective value of the induction expressed in Tesla, $e$ is the diameter of the liquid metal expressed in meters, $\rho$ is the resistivity of the liquid metal in ohm-meter, and $f$ is the frequency in Hertz of the supply current for the inductor.

It is possible to define a certain admissible range of variations of the effective value of induction. The lower limit of the range of the variations is determined by the fact that the magnetic pressure in the region at the front of the solidification has to have a minimum value as defined above. The upper limit of the admissible variations of the effective value of induction is dictated solely by metallurgical considerations. The inventor has discovered that a too intense mixing of the liquid metal will produce in the region at the front of the solidification a so-called negative segregation zone corresponding to a localized improverishment of alloying elements contained in the steel composition cast, especially of sulfur, which gives rise to an axial heterogeneity continuing through the cast product. This phenemonon of negative segregation is marked the more, the greater is the intensity of the mixing action. It has been experimentally established that this phenomenon begins to develop in a notable manner for an induction value which is substantially 1½ times the value at which a minimum magnetic pressure is obtained which causes arrest of basaltic growth and which corresponds to a particular value $a = 5.3$ or $$B_o = 5.3 \sqrt{\frac{\rho}{f}} \cdot \frac{1}{e}.$$

Thus, in the case of steel having in liquid state a resistivity of $160 \times 10^{-8}$ ohm-meter and submitted to the action of a magnetic field created by a bipolar inductor supplied with a frequency of 50 Hertz, the admissible variations of the effective induction value may be expresed as follows:

$$\frac{625}{e} < B_o < \frac{940}{e}$$

in which, for reasons of convenience, $B_o$ is expressed in gauss and $e$ is expressed in centimeter. As set forth in the equation (2) the value of the magnetic pressure varies with the square of the induction, which means that the permissible variations of the effective value of the magnetic pressure extends from a minimum value of 120 Pascal to about 2.25 times this value, that is 270 Pascal.

In the preceding part of the disclosure a plurality of criteria have been set forth for producing the desired solidification of metal during its continuous casting. However, the criteria set forth above will not assure a constant result during such a continuous casting operation. In fact, the speed of the casting, that is the speed of withdrawal of the cast product has also to be considered as a variable. Thus, the speed of withdrawal of the cast product may increase at the beginning of the operation, decrease near the end of the operation and change in a more or less important manner during the operation. These variations, controlled usually by the operator, permit especially to take into account the variations of the temperature of the metal introduced into the mold and these variations permit, on the one hand, to maintain the maximum output and, on the other hand, a satisfactory operation of the casting apparatus.

From this results that the thickness of the solidified skin in the zone of action of the magnetic field varies, and this variation conforms to the law of solidification:

$$E_S = kt^{0.5}$$

in which, considering the location of the preferred zone at which the electromagnetic inductor 6 is located, as set forth above, the time is set forth by the relation:

$$t = H/V$$

in which $H$ is the metallurgical distance of the mean level of action of the magnetic field and the upper level of the liquid metal in mold 1, which distance is equal to half of the metallurgical length, and $V$ is the speed of extraction of the cast product.

The diameter of liquid metal at the mean level of the action of the magnetic field can therefore be expressed by the equation:

$$e(V) = E - 2k \sqrt{\frac{H}{V}} \qquad (5)$$

in which E is the external diameter of the billet.

Consequently, the equations (3) and (4) giving the minimum and maximum of the effective values of the induction may be written in the form:

$$B_o = a \sqrt{\frac{\rho}{f}} \cdot 1/(E - 2k \sqrt{\frac{H}{V}}) \qquad (6)$$

in which $$3.5 \leqq a \leqq 5.3 \frac{\text{Tesla} \cdot m}{S^{0.5} \cdot \Omega m^{0.5}}.$$

Conforming with this feature of the method according to the present invention, the value of the magnetic pressure is maintained at a substantially constant value, advantageously between the limits set forth above by modifying the effective value of the induction $B_o$ as a function of the variations of the withdrawal speed V according to the equation (6). The withdrawal speed may, for instance, be measured by a measuring instrument associated wtih one of the rollers 4. The signal delivered by this measuring instrument may be applied to control means which regulate the voltage of the supply current for the coils of the electromagnet inductor 6 in order to modify the intensity of the electric field. For this purpose, the aformentioned control means will include calculating means which permit to solve the equation (6) as a function of the initial parameters introduced, such calculating being well known in the art.

The initial regulation of the intensity of the magnetic field is effected as a function of nominal conditions of the operation of the casting apparatus, that is as a function of the dimensions of the cast product and the nominal withdrawal speed of the same. The effective value of the induction in air produced by the inductor in the absence of the cast product may be measured by a gaussmeter to determine the initial value of $B_o$; in fact, the permeability of air is very close to the permeability of molten steel. The value $B_o$ may likewise be determined from characteristic curves corresponding to the particular inductor used.

The nominal value of the withdrawal speed is a value corresponding to the normal rate of the installation. This value is liable to be surpassed only occasionally during the casting process and the disadvantage liable to result therefrom may consist in the local occurrence of the above-mentioned phenemonon of negative segregation. In fact, when the withdrawal speed rises, the diameter of the liquid metal in the mixing zone, that is the zone in which the electromagnetic field is maintained, rises likewise conforming to the equation (5). Therefore, an excessive mixing may result if the effective induction $B_o$ is not modified according to the equation (6), inasmuch as the initial value of $B_o$ has been chosen such that the value of the magnetic pressure developed at the front of the solidification for a nominal value of the withdrawal speed is located at the upper limit of the admissible variation of the magnetic pressure. The control means for controlling the voltage supplied to the inductor 6 will act in conformity with the equation (6) to reduce the induction and to thus maintain the value of the magnetic pressure developed at the front of the solidification at a substantially constant value located within the above admissible variations.

During the course of operation, it will, however, more often occur that the withdrawal speed is inferior to the nominal withdrawing speed. In this case, in conformity with the equation (5), the diameter of the liquid metal in the mixing zone will be reduced. As a consequence, the formation of the bridges of solidification is liable to occur for two reasons; first of all, the opposite points at the front of the solidification will be closer together, which favors thus the formation of bridges of solidification, and secondly, the intensity of the magnetic field, if not modified, is liable to create in the zone at the front of the solidification a magnetic pressure of insufficient value to arrest basaltic growth. While the first effect could be compensated by modifying the position of the electromagnetic inductor, such cannot be carried out in connection with an apparatus for continuous casting. In any case, by modifying the effective value of the induction $B_o$, in conformance with the equation (6), a value of the magnetic pressure superior to the minimum pressure is restored in the zone at the front of the solidification to thus arrest basaltic growth. Consequently, the first-mentioned effect will not take place, nevertheless, it is preferable for security reasons to choose the initial value of $B_o$ in such a manner that the magnetic pressure developed at the front of the solidification for a nominal withdrawal speed is an elevated value within the permissible variations of the magnetic pressure.

While the above considerations referring to the admissible variations of the magnetic pressure have been developed with reference to a product of circular cross section, the conclusions which follow therefrom may likewise be applied to cast products which have not a circular cross section, for example to cast products of square cross section, of rectangular cross section or other cast products which may be continuously cast if their outer dimensions are compatible with the specific electromagnetic inductor employed.

In fact, the rotating field created by such an inductor exists at each point of the liquid metal independent of the configuration of the border which separates the liquid phase from the solid phase of the cast product. The rotating magnetic field creates in the presence of the induced current mechanical forces giving rise to a plurality of local rotating movements in the liquid metal and the total of such movements constitute the mixing effect. If the cast product is of circular cross section, the resulting action of these movements will give rise to a total rotation of the liquid metal, the sliding movement of which is nevertheless extremely important. The more the external shape of the cast product deviates from a surface of revolution, the less will be the total movement of revolution which is liable to be produced in the liquid metal portion, however, the local movements of rotation will remain substantially the same and produce a mixing effect of the same nature. The equation (2) giving the value of the magnetic pressure can in practice be applied to a cast product of square cross section by using, instead of the diameter of the liquid metal, the width of the liquid metal in the section which is submitted to the action of the magnetic field.

For a billet of square cross section the width of the billet is to be placed for E in the formula (6) and the inductor is to be located and regulated as if it would effect a mixing treatment onto a billet of circular cross section of the diameter E following the same law of solidification as a billet of square cross section.

In the case of a billet of rectangular cross section, the formula (6) may also be used by using for E the smaller side of the rectangle. In fact, the bridges of solidification are liable to develop between opposite points of the front of solidification which are most closely to each other. From this may follow, in certain zones, a value of the magnetic pressure liable to be outside of the admissible variations of such pressure which may lead to the mentioned negative segregations. This phenomenon may be mitigated by choosing an initial value of induction corresponding to a value of magnetic pressure located within the mean value or the smallest value within the admissible variations of the magnetic pressure, while considering in any case that it is most important to suppress formation of bridges of solidification.

FIG. 3 is an axial cross section through a billet produced by a continuous casting process according to the prior art, that is, in which the billet during its solidification was not subjected to the mixing treatment according to the present invention. The structure of solidification of this billet is rendered visible by a sulfur print, a well known method of chemicaly attacking the metal surface to obtain an image of the structure.

The profile of the billet is that of a square with a length of each side of 120 mm, which follows in this special case the law of solidification of $E_S = 29\ \sqrt{t}$. The cast metal was a nickel-chrome steel containing 0.16% of carbon, 1.7% of nickel and 0.3% of chrome.

The nominal withdrawal speed during the casting was 1.5 meters per minute.

As can be seen from FIG. 3, the billet thus produced presents, especially in its axial zone, interesting irregularities of solidification. While the outer skin has a fine structure throughout, a basaltic structure is created over a variable distance toward the axis of the billet which gives rise to the formation of bridges of solidification according to the process described above. Such bridges of solidification will separate the axial zone of the billet in a succession of sub-ingots with the formation of shrink holes in the upper portions of these sub-ingots.

Figure 4:
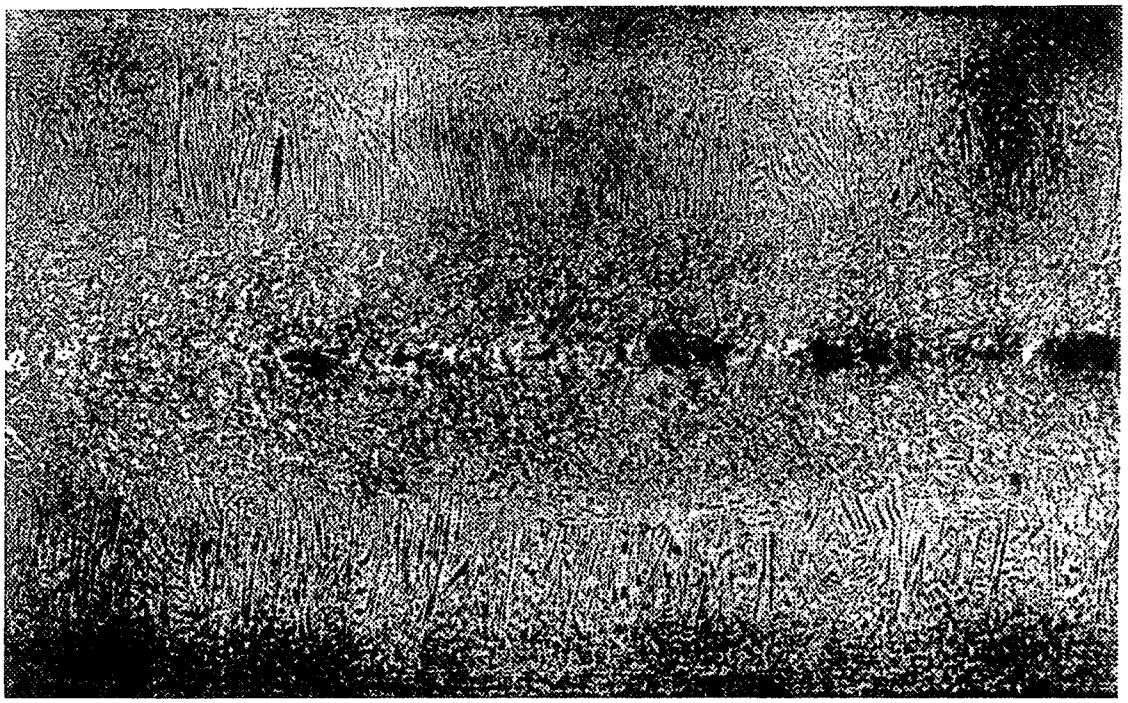
FIG. 4 is a partial axial cross section through a casting produced according to the method of the present invention.

FIG. 4 represents an axial cross section through an identical billet cast under the same general conditions but submitted to a mixing treatment according to the method of the present invention.

The metallurgical length for the nominal speed of withdrawal was in the neighborhood of 7.4 meters and the electromagnetic inductor was placed at a mean distance of 3.7 meters below the mold 1. The maximum withdrawal speed was 2.5 meters per minute and the electromagnetic inductor affected a zone of the casting extending for a distance of 22 centimeters to opposite sides of the mean level of the inductor, as defined above. The inductor used was a bipolar stator supplied with a three-phase current of 50 Hertz. The nominal induction was chosen in a manner respecting the relation $$\frac{625}{e} < B_o < \frac{940}{e}$$

established above.

The nominal withdrawing speed was 1.7 meters per minute, the thickness of the solidified material in the median zone of the action of the magnetic field was 4.28 cm, that is $e = 3.44$ cm, which established the effective value of the induction within the limits:

$$182 \text{ gauss} < B_o < 273 \text{ gauss.}$$

For safety reasons, the nominal value of the induction $B_o$ has been chosen with 220 gauss. The withdrawal speed was liable to vary between 1.5 meters per minute and 1.9 meters per minute, from which results a corresponding variation of $B_o$ between 261 gauss and 194 gauss corresponding to the equation (6) which variations permitted to maintain a constant magnetic pressure at the front of the solidification and to arrest in this way basaltic growth. The prevention of basaltic growth due to the mixing effect produced is clearly shown in FIG. 4, formation of sub-ingots has been completely prevented and the homogeneity in the axial zone of the billet is greatly improved. Analyses carried out, as to the carbon content in the axial zone, have shown that the variations of the carbon content do not surpass 20 $\times 10^{-3}$%, which corresponds roughly to a third of such variations encountered without the mixing treatment according to the present invention. Vickers hardness tests carried out in the axial zone have shown variations of about 20%, which represents half of such variations encountered in the absence of a mixing treatment. Finally, any porosity in the axial zone of the cast products which have been submitted to the mixing treatment according to the present invention has been greatly reduced and shrink holes have been completely suppressed.

Figure 5:
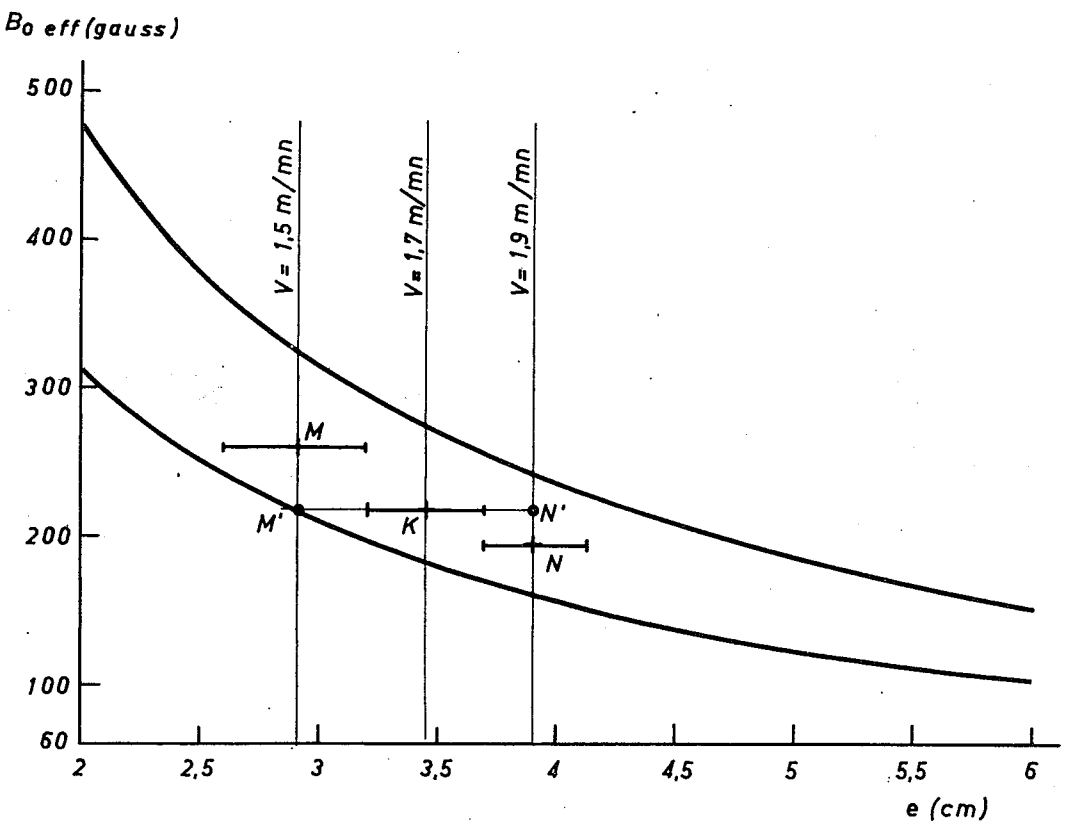
FIG. 5 is a diagram showing the effective induction field in relation to the thickness of the liquid metal.

FIG. 5 is a diagram presented as illustration of the method according to the present invention and referring to the particular example of treatment described with reference to FIG. 4. The effective induction $B_o$ is plotted along the ordinate of the diagram and the thickness $e$ of the liquid metal is plotted along the abscissa. The limits of permissible variations of the magnetic pressure are delimited in the case under consideration by the two hyperbolic curves corresponding respectively to the relation $$B_o = 625/e$$

and $$B_o = 940/e.$$

For the nominal withdrawal speed of the cast product of 1.7 meters per minute, an effective value of induction of 220 gauss has been chosen. The represented point of this regulation is designaged with K, the abscissa of this point, the width of the liquid metal in the median zone of action of the magnetic field, is 3.44 cm. As can be seen, the point K is situated within the permissible variations of $B_o$ for the width of the liquid metal under consideration. During the operation the speed of withdrawal is liable to be changed, for example, in order to take care of the variations of the temperature of the liquid metal introduced into the mold. In the example illustrated in the diagram of FIG. 5, the speed of withdrawal of the casting may vary between 1.9 meters per minute and 1.5 meters per minute. For a withdrawal speed of 1.9 meters per minute the thickness of the liquid metal in the median zone of the action of the magnetic field is 3.90 cm. In the absence of any regulation of the induction the correspondent point of function would be the point N′ shown in the diagram, which point corresponds to a relatively high magnetic pressure. It has to be further taken into consideration that the zone of action of the magnetic field extends to opposite sides of the median zone of action, from which follows that the magnetic pressure developed at certain points in front of the solidification would surpass the upper limit described corresponding to the degree of solidification of the cast product. Corresponding to the relation set forth in the formula (6), the induction is therefore reduced to a value of 194 gauss and the corrected point of function is the point N located within the permissible variations. The extension of the zone of action of the magnetic field, considering the longitudinal dimension of the inductor 6, that is 44 cm in the given example, is also represented in the diagram of FIG. 5.

The width of the liquid metal in the median zone of action of the magnetic field, for a withdrawal speed of 1.5 meters per minute, is 2.9 cm. In the absence of any regulation of the inductor the corresponding point of function would be the point M′ shown in the diagram. This point is located at the lower limit of the permissible variations and it constitutes, as mentioned above, a median point of function. From this results that the value of the magnetic pressure would be insufficient to prevent basaltic growth. Regulation of the induction $B_o$ according to equation (6) will bring the point of function to the point M so as to develop in the mixing zone a magnetic pressure located within the prescribed limits and preventing correspondingly the occurrence of basaltic growth. It will be noted that the points K, M and N in the diagram of FIG. 5 relate to a regulation of the induction corresponding to the same value of the magnetic pressure in the median zone of action of the inductor 6. This value is in the case under consideration in the neighborhood of 175 Pascal.

The variations of the withdrawal speed illustrated in the diagram of FIG. 5 correspond to the normal operation of an apparatus for continuously casting metal. It is to be understood that at the start of an operation, the withdrawal speed will be extremely slow and will increase rapidly to attain in a few minutes a withdrawal speed located within the limits shown in the diagram of FIG. 5. It is therefore practically impossible to proceed with a treatment of mixing the corresponding sections of the cast product right at the start of the casting operation, as the product is liable to be completely solidified during its passage past the inductor. It has, however, to be considered that the formation of bridges of solidification is less liable to occur when the withdrawal speed is very slow. The same considerations are likewise applicable during a considerable reduction of withdrawal speed which occurs at the end of the casting operation.

The method according to the present invention is applicable for the continuous casting of products mentioned and it permits to improve the quality of these products by modifying especially the characteristics of the structure of solidification in the axial zone of such products.

The most decisive advantage of the method according to the present invention resides, however, in the fact that it permits to increase the output of an apparatus for continuous casting. In fact, in the method according to the prior art it was often necessary to use a relatively small withdrawal speed in order to avoid forming of sub-ingots during the solidification of the cast metal. The application of the method according to the present invention permits to utilize an apparatus for continuous casting for a maximum output by proceeding with withdrawal speeds which did not have to be considered previously.

It will be understood that each of the elements described above, or two or more together, may also find a useful application in other methods of continuously casting metal differing from the method described above.

While the invention has been illustrated and described as embodied in a method for continuously casting metal while controlling the structure of solidification thereof, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method to control the structure of solidification of a continuously cast metal product in which the product is subjected during its solidification to the action of a rotating magnetic field produced by a bipolar inductor to provoke in a central still liquid portion of the product and at least in a zone bordering the inner surface of the already solidified outer skin a rotary movement of the liquid metal, said method comprising the steps of continuously discharging a stream of molten metal in downward direction; cooling the stream of molten metal to gradually solidify the same; continuously withdrawing the thus solidified metal; continuously measuring the speed at which the product is withdrawn; and regulating the intensity of the magnetic field as a function of variations of the withdrawal speeds so as to maintain constant a value $a$ defined by the equation:

$$a = B_o \cdot e(V) \cdot \sqrt{\frac{f}{\rho}},$$

in which $B_o$ is the effective value in Tesla of the induction in air in the region at the border of the solidified and liquid metal; $f$ is the frequency in Hertz of the current supplied to the bipolar inductor producing the rotating magnetic field, the magnetic field produced corresponding to a magnetic field applied to a reference product of circular cross section of a diameter equal to the minimum width of the product cast and following the same law of solidification as the cast product; $\rho$ is the resistivity of the liquid metal cast in $\Omega m$; and $e(V)$ is the medium distance between two opposite points at the border between the still liquid and the already solidified metal in the zone of action of the magnetic field and measured in the direction normal to the outer surface of the cast product, said distance being defined by the equation:

$$e(V) = E - 2k \sqrt{\frac{H}{V}},$$

in which $E$ is the distance in meters between two opposite points of the outer surface of the product in the zone of action of the magnetic field and measured in the direction normal to said surface, $k$ is a coefficient of solidification specific to the metal cast, $V$ is the instantaneous withdrawal speed of the product expressed in meters per minute, and $H$ is the metallurgical distance in meters between the median level of action of the magnetic field and the level at which the whole cross section of the cast metal is in the liquid state.

2. A method to control the structure of solidification of a continuously cast metal product in which the product is subjected during its solidification to the action of a rotary magnetic field produced by a bipolar inductor to provoke in a central still liquid portion of the metal and at least in a zone bordering the inner surface of the already solidified outer skin a rotary movement, said method comprising the steps of continuously discharging a stream of molten metal in downward direction; cooling the stream of molten metal to gradually solidify the same; continuously withdrawing the thus solidified metal; continuously measuring the speed at which the product is withdrawn; subjecting the partially solidified metal to the action of the rotating magnetic field produced by a bipolar inductor in a region in which the relationship of the total thickness of the solidified metal to the width of the cast product is substantially 1 : 2; and regulating the intensity of the magnetic field as a function of variations of the withdrawal speed so as to maintain constant a value $a$ defined by the equation:

$$a = B_o \cdot e(V) \cdot \sqrt{\frac{f}{\rho}}$$

in which $B_o$ is the effective value in Tesla of the induction of air at the region at the border of the solidified and the liquid metal, $f$, is the frequency in Hertz of the current supplied to the bipolar inductor producing the rotary magnetic field, the magnetic field produced corresponding to the rotary magnetic field applied to a reference product of circular cross section of a diameter equal to the minimum width of the product cast and following the same law of solidification as the cast product, $\rho$ is the resistivity of the liquid metal cast in $\Omega\ m$, and $e(V)$ is the medium distance between two opposite points at the border between the still liquid and the already solidified metal in the zone of action of the magnetic field and measured in the direction normal to the outer surface of the cast product, said distance being defined by the equation:

$$e(V) = E - 2k \sqrt{\frac{H}{V}},$$

in which $E$ is the distance in meters between two opposite points of the outer surface of the product in the zone of action of the magnetic field and measured in the direction normal to said surface, $k$ is a coefficient of solidification specific to the metal cast, $V$ is the instantaneous withdrawal speed expressed in meters per minute, and $H$ is the metallurgical distance in meters between the medium level of action of the magnetic field and the level at which the whole cross section of the cast metal is in the liquid state.

3. A method as defined in claim 1, in which the constant $a$ is maintained between $$3.5 \text{ to } 5.3 \ \frac{\text{Tesla}\cdot m}{S^{0.5}\Omega m^{0.5}}.$$

4. A method as defined in claim 2 in which the constant $a$ is maintained between $$3.5 \text{ to } 5.3 \ \frac{\text{Tesla}\cdot m}{S^{0.5}\Omega m^{0.5}}.$$

* * * * *